US008109782B2

(12) United States Patent
Ziegler et al.

(10) Patent No.: US 8,109,782 B2
(45) Date of Patent: Feb. 7, 2012

(54) ELECTRICAL CONNECTING ELEMENT AND DISK EQUIPPED WITH SUCH AN ELEMENT

(75) Inventors: Stefan Ziegler, Aachen (DE); Mitja Rateiczak, Wurselen (DE); Bernhard Reul, Herzogenrath (DE)

(73) Assignee: Saint-Gobain Glass France, Aubervillers (FR)

( * ) Notice: Subject to any disclaimer, the term of this patent is extended or adjusted under 35 U.S.C. 154(b) by 0 days.

(21) Appl. No.: 12/678,284

(22) PCT Filed: Sep. 19, 2008

(86) PCT No.: PCT/EP2008/007878

§ 371 (c)(1),
(2), (4) Date: Jul. 1, 2010

(87) PCT Pub. No.: WO2009/040057

PCT Pub. Date: Apr. 2, 2009

(65) Prior Publication Data

US 2010/0285685 A1 Nov. 11, 2010

(30) Foreign Application Priority Data

Sep. 20, 2007 (FR) ..... 07 57702

(51) Int. Cl.
*H01R 4/38* (2006.01)

(52) U.S. Cl. ..... 439/382

(58) Field of Classification Search ..... 439/382, 439/77; 219/203; 29/857
See application file for complete search history.

(56) References Cited

U.S. PATENT DOCUMENTS 2,502,147 A * 3/1950 Grothouse ..... 392/437
3,634,654 A * 1/1972 Peetz et al. ..... 219/522
3,926,357 A * 12/1975 Matrisian ..... 228/110.1
4,023,008 A * 5/1977 Durussel ..... 219/522
4,555,607 A * 11/1985 Roentgen et al. ..... 219/765
4,707,591 A * 11/1987 Sprenger ..... 219/541
4,918,288 A * 4/1990 Carter et al. ..... 219/203
5,134,248 A * 7/1992 Kiec et al. ..... 174/84 R
5,738,554 A * 4/1998 Borger et al. ..... 439/874
5,748,155 A * 5/1998 Kadunce et al. ..... 343/713

(Continued)

FOREIGN PATENT DOCUMENTS

EP 1657964 5/2006

(Continued)

OTHER PUBLICATIONS

PCT International Search Report for PCT/EP2008/007878 filed on Sep. 19, 2008 in the name of Saint-Gobain Glass France.

(Continued)

*Primary Examiner* — Tulsidas C Patel
*Assistant Examiner* — Vladimir Imas
(74) *Attorney, Agent, or Firm* — Steinfl & Bruno LLP

(57) ABSTRACT

Electrical connecting element (2) that is designed to be welded or soldered onto an electrically conductive component (11) of a window pane, comprising an electrically conductive body (20), of which one section is designed to be welded or soldered onto the component (11) for its electrical connection, and of which another if section is designed to be connected in the direction of the outer side of the window pane, characterized in that the body comprises an electrically conductive foil (21) with a thickness between 1 and 500 μm and intermediate means (5, 6) that serve as shock-absorbing means between the stiff section of the body of the connecting element and the window pane.

28 Claims, 5 Drawing Sheets

U.S. PATENT DOCUMENTS

| | | | | |
|---|---|---|---|---|
| 5,867,128 | A * | 2/1999 | Sauer | 343/713 |
| 5,902,536 | A * | 5/1999 | Shumaker et al. | 264/263 |
| 6,103,034 | A * | 8/2000 | Fujiwara et al. | 156/73.1 |
| 6,103,998 | A * | 8/2000 | Kuno et al. | 219/203 |
| 6,103,999 | A * | 8/2000 | Nishio et al. | 219/203 |
| 6,217,373 | B1 * | 4/2001 | Johnston | 439/499 |
| 6,396,026 | B2 * | 5/2002 | Gillner et al. | 219/203 |
| 6,421,018 | B1 * | 7/2002 | Zeilinger et al. | 343/713 |
| 6,534,720 | B2 * | 3/2003 | Von Alpen et al. | 174/149 R |
| 6,793,120 | B2 * | 9/2004 | Johnson | 228/122.1 |
| 6,834,969 | B2 * | 12/2004 | Bade et al. | 359/507 |
| 7,134,201 | B2 * | 11/2006 | Ackerman et al. | 29/857 |
| 7,180,031 | B1 * | 2/2007 | Loibl et al. | 219/203 |
| 7,223,939 | B2 * | 5/2007 | Hoepfner et al. | 219/203 |
| 7,247,047 | B2 * | 7/2007 | Baranski et al. | 439/495 |
| 7,270,548 | B2 * | 9/2007 | Jenrich et al. | 439/34 |
| 7,344,059 | B2 * | 3/2008 | Johnson | 228/44.3 |
| 7,514,654 | B2 * | 4/2009 | Okajima et al. | 219/522 |
| 7,675,004 | B2 * | 3/2010 | Nakajima et al. | 219/209 |
| 2002/0111081 | A1 * | 8/2002 | Machado | 439/876 |
| 2003/0034172 | A1 | 2/2003 | Alpen et al. | |
| 2003/0155467 | A1 * | 8/2003 | Petrenko | 244/134 R |
| 2005/0112291 | A1 | 5/2005 | Okajima et al. | |
| 2005/0115954 | A1 * | 6/2005 | Gerhardinger et al. | 219/543 |
| 2005/0269312 | A1 * | 12/2005 | Gerhardinger | 219/543 |
| 2008/0164248 | A1 | 7/2008 | Reul | |

FOREIGN PATENT DOCUMENTS

| | | |
|---|---|---|
| WO | 2004/009350 | 1/2004 |

OTHER PUBLICATIONS

PCT Written Opinion for PCT/EP2008/007878 filed on Sep. 19, 2008 in the name of Saint-Gobain Glass France (English Translation Only).

* cited by examiner

FIG. 4
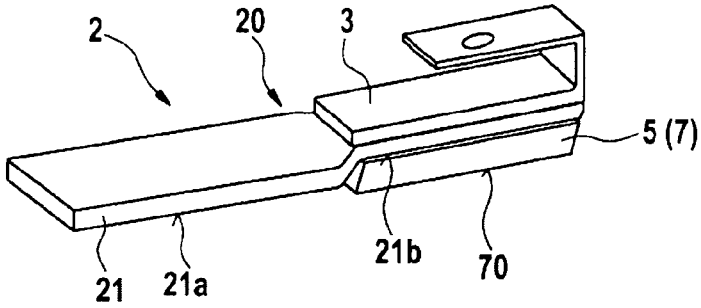
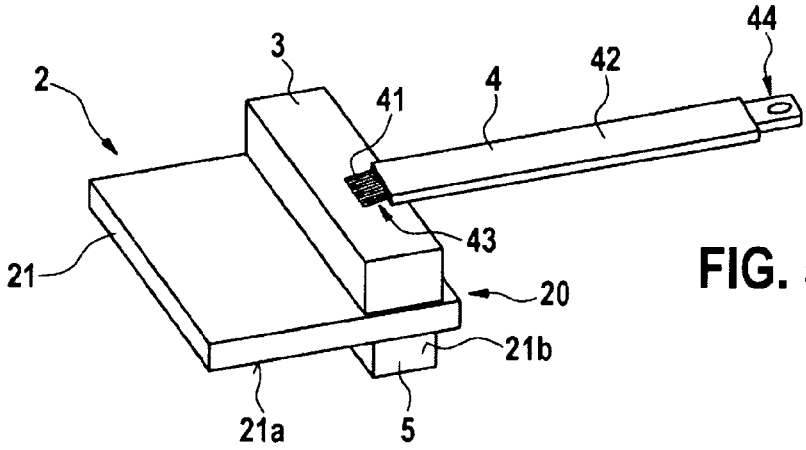
FIG. 5
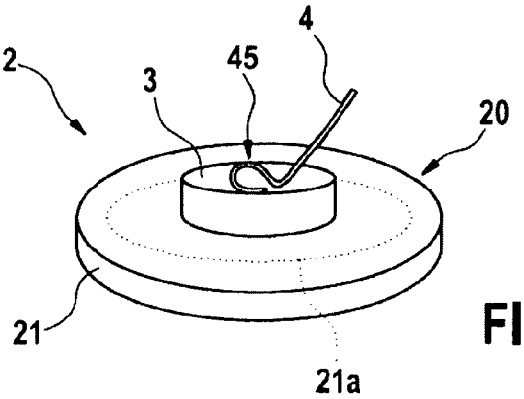
FIG. 6
FIG. 7
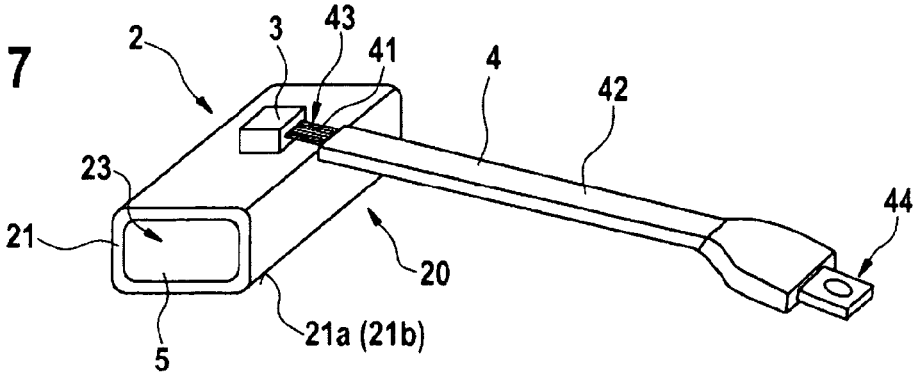

ELECTRICAL CONNECTING ELEMENT AND DISK EQUIPPED WITH SUCH AN ELEMENT

CROSS REFERENCE TO RELATED APPLICATIONS

The present application is the US national stage of International Application PCT/EP2008/007878 filed on Sep. 19, 2008 which, in turn, claims priority to French Application FR0757702000, filed on Sep. 20, 2007.

FIELD

The invention relates to an electrical connecting element for a window pane that are equipped with electrical conductive components, such as, for instance, electrical connection surfaces of conductive structures that are applied on the surface of the window pane of the antenna field or heating field type that are formed by conductively printed wires or of the electrically conductive layer type. The connecting element serves to electrically connect the conductive structures of the window pane with an electrical system or electrical systems that are disposed outside the window pane (amplifiers, control units, power sources). The invention is applied, in particular, with heated windows or antennas.

BACKGROUND

To form a heated window of the type of a rear window of an automobile, a series of narrow resistance strips that are made from a pasty suspension in an organic binder of metallic silver and molten glass, in other words, a low-melting-point glass, are deposited on a glass film by screen printing. After baking, a network of fine electrically conductive strips is obtained that flow into larger collecting strips of analogous composition that are arranged near the edges of the glass film so as not to obstruct the driver's view. Metallic connecting parts that form cable shoes for the power supply of the vehicle are then soldered to these lateral collecting strips.

These metallic connecting parts are formed, for example, in a T shape, from stiff plates made of copper, whose two branches are extended by feet, under which the solder is deposited. The connecting part is heated by any known process, such as, for instance, by conduction or convection, to cause the solder to melt and to ensure, after cooling, a permanent connection between the collecting strip and the connecting part.

For a long time, the solder used has been lead based because of its suitable ductility. In fact, this metal enables minimization of the stresses that can occur the window glass in the solder zone during rapid cooling processes and increases in the temperature of the window pane that is provided with its stiff connecting part, for example, during heat resistance tests, for which the window panes are subjected, in a closed housing, to temperature fluctuation cycles between −40° C. and +90° C. inside this housing.

For environmental protection reasons, it is necessary to replace the lead with other materials, such as tin-based alloys, for instance. However, tin is a much less ductile material. Its presence between a stiff metallic connecting part and the glass film that is provided with components for the connection, does, in fact, ensure an electrical connection and mechanical retention of the part, but ultimately results in direct contact between the stiff part and the glass film. At the time of retraction of the metallic part, in particular, when it is subjected to a sharp cooling in temperature, this direct contact between the part and the glass causes, in principle, the occurrence of stresses in the glass. In connection with the fact that the glass used is becoming increasing thinner and that it cannot be annealed (i.e., is less robust), the stresses in the glass usually result in breakage of the window pane.

Another solution of the connecting element can consist in using a flat substrate made of plastic that is affixed to the glass film by gluing, with metallic elements embedded in this substrate and electrical connection points included on a free end, which connection points protrude from the substrate in order to be solidly connected with the electrical components of the window pane, with the electrical connection occurring with a stiff part of a power connector on the opposite end of the metallic elements and of the substrate made of plastic material. The plastic substrate permits affixing the connecting element and does not result in direct contact between the stiff part and the electrical components of the window pane.

Such a configuration is, for example, described in the patent EP 766 338 B1. However, this solution has proven to be expensive, in particular because of the necessity of the plastic substrate and of the encasing of the metallic elements inside this substrate.

SUMMARY

Consequently, an object of the invention is to provide a solution for the electrical connection on a window pane that, without using lead, minimizes the disadvantages of the generation of stresses in the glass while the window pane is subjected to temperature fluctuations, without, in the process, increasing the production costs of this connection and, ultimately, those of the window pane.

According to the invention, the electrical connecting element that is designed to connect with at least one electrically conductive component of a window pane and includes an electrically conductive body, characterized in that the electrically conductive body comprises at least one electrically conducting foil that has a thickness between 1 and 500 μm, with the foil having at least one electrical connection surface that is designed to be in contact with the component, and at least one affixing surface that is designed to affix the connecting element on the window pane, and in that the body includes an electrically conductive stiff section or an electrically conductive stiff part that is connected to the foil or is intended to be connected thereto, with the body having intermediate means such that the stiff section or the stiff part is not designed to be directly in contact with the window pane through the single thickness of the foil.

The electrically conductive foil thus enables, simultaneously, the electrical connection of the connecting element as well as its affixing. It thus serves directly as the substrate for affixing the element on the window pane.

Moreover, its low thickness, which is less than 500 μm, preferably between 1 and 200 μm, and, in particular, between 1 and 100 μm, makes it possible that no strong stresses are generated over the glass when the connecting element is subjected to temperature fluctuation cycles.

This connecting element additionally makes possible, by using intermediate means the prevention of direct contact between the window pane and the stiff section or the stiff part, the connection outside the window pane, and is susceptible to thermal stresses. Consequently, there is no transfer of thermal stresses in the glass.

According to one characteristic, the intermediate means are shock-absorbing intermediate means; they are not made of pure metal and thus prevent forming a rigid connection that is capable of transferring stresses between the stiff section of the body of the connecting element or the stiff connected part and the window pane. The intermediate means thus constitute an adequately ductile mechanical connection.

The intermediate means consist of a shock-absorbing material or of an air layer that is arranged or is intended to be arranged on one of the surfaces of the electrically conducting foil, while located facing the stiff section or the stiff part.

The shock-absorbing material is, for example, plastic-based. The shock-absorbing material may, however, be electrically conductive, in that it contains, for example, metal particles.

According to a further characteristic, the intermediate means have a thickness of 1 to 2500 μm.

Advantageously, the electrically conducting foil is a flexible metallic foil, with the metal having the advantage of being malleable, having a high melting point, and high electrical conductivity. The foil may be, in particular, silver-, copper-, gold-, or aluminum-based.

By way of example, the electrically conductive foil may include one or a plurality of metal layers, in particular, at least one copper layer and at least one layer that contains silver, tin, and/or copper, with this layer designed to be in contact with the component of the window pane.

According to a further characteristic of the invention, the affixing surface of the electrically conductive foil is separate from the electrical connection surface or formed by the electrical connection surface.

Preferably, the electrical connection surface is designed to accommodate electrically conductive adhesive or designed to be soldered or welded.

Advantageously, the affixing surface includes affixing means.

The affixing means may be formed by a two-sided adhesive strip that is preferably provided with a protective coating on the surface opposite that facing the affixing surface.

The affixing surface may also be provided to accommodate the adhesive.

According to one embodiment, a shock-absorbing material is arranged facing the stiff section or the stiff part on the opposing surface of the foil, which supports this section or this part, with the shock-absorbing material solidly connected with the affixing surface and designed to be affixed on the window pane.

The shock-absorbing material may, furthermore, form affixing means, if it comprises, for example, a two-sided adhesive strip.

According to another embodiment, a shock-absorbing material is arranged against the stiff section or the stiff part and on the surface of the foil that supports this section or this part.

According to another characteristic, the stiff section or the stiff part is thicker than the foil and is connected or is intended to be contacted with an electrical conductor that is guided outside the window pane.

Preferably, the stiff section or the stiff part is contains [sic] metal, such as copper.

According to one embodiment of the foil, it is folded such that it forms an envelope that has an internal accommodation to house the intermediate means, such as, for instance, a shock-absorbing material.

Advantageously, at least the surface of the foil that is designed to be in contact with the window pane has a polygonal shape with round corners, which further minimizes the risk of the passage of stresses.

The connecting element of the invention is, consequently, advantageously used in window panes, preferably in heated windows or with antennas, as well as in buildings or in locomotive machines, in particular automobiles or trains or aircraft or even watercraft.

Although the above described connecting element according to the invention is thus ready for installation and, consequently, easy to implement, it is also possible to mount all components that make up the connecting element separately on the window pane.

In addition, the invention relates to a window pane, comprising at least one glass film, at least one electrically conductive component that is deposited on the glass film, and at least one electrical connecting element that includes an electrically conductive body that is connected with the component, characterized in that the electrically conductive body includes at least one electrically conductive foil that has a thickness between 1 and 500 μm, with the foil including at least one electrical connection surface that is in contact with the component, and at least one affixing surface that is solidly connected with the window pane, and in that the body includes a stiff section that is connected with the foil, or in that an electrically conductive stiff part is connected to the foil, with intermediate means connected with the body such that the stiff section or the stiff part is not directly in contact with the window pane through the single thickness of the foil.

According to a preferred embodiment, the intermediate means are formed from a shock-absorbing material that is connected by one of its surfaces on the affixing surface of the foil and is solidly connected by its opposite surface with the window pane.

And finally, the invention also relates to a method of assembly of a connecting element such as is described above, with the intermediate means formed from a shock-absorbing material that is connected on the affixing surface of the electrically conductive foil of the body of the connecting element,

- affixing the shock-absorbing material on the window pane, by, for instance, gluing, with the electrical connection surface of the foil placed against the component,
- soldering the foil onto the component of the window pane or welding or gluing the foil that had been previously brought into connection with the surface of the foil to be solidly connected and which is to be soldered, [or with the surface] of the solder joint or of the electrically conducting adhesive,
- and welding the stiff part that is designed for the connection in the direction of the outside of the window pane if this is not part of the connecting element, or has not yet been connected, onto the foil opposite the shock-absorbing material.

BRIEF DESCRIPTION OF THE DRAWINGS

Additional advantages and characteristics of the invention are now described in detail with reference to the appended drawings, wherein:

FIG. 4 through 7 depict two side views of examples of the design of the connecting element;

The figures are not to scale to facilitate reading.

DETAILED DESCRIPTION

Figure 1:
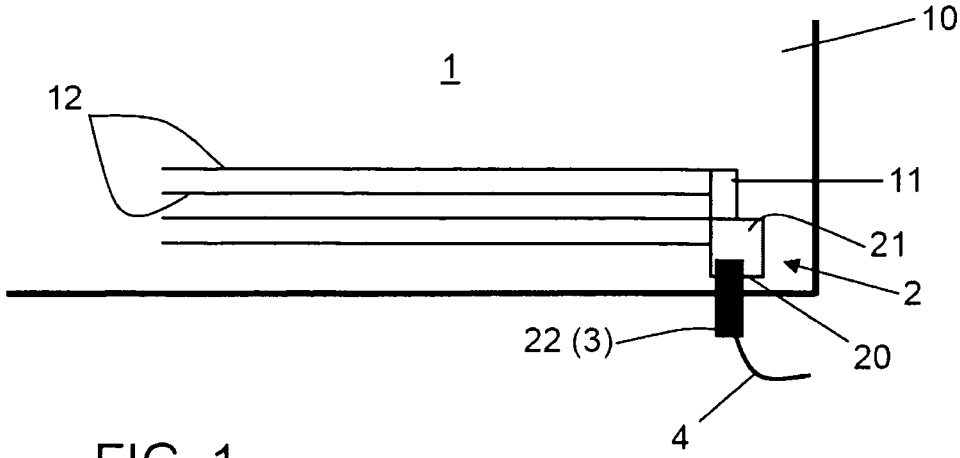
FIG. 1 depicts a partial view from above of a window pane that is provided with a connecting element according to the invention.

FIG. 1 depicts a window pane 1, comprising at least one glass film 10, at least one electrically conductive component 11, for example, a silver-based conductive strip, that combines the electrical connection of a conductive structure, for instance, a plurality of heating wires 12 or an antenna integrated into the window pane.

An electrical conducting element 2 according to the invention is arranged on the window pane, in that it is electrically connected with the component 11, e.g., for its power supply.

Figure 2:
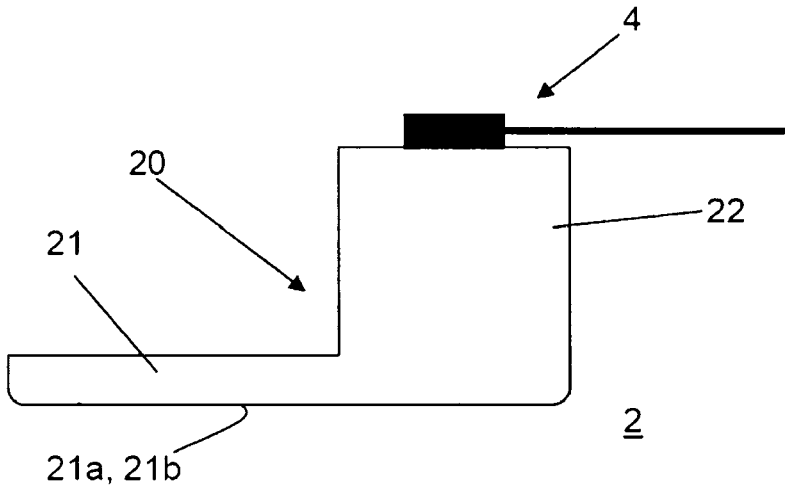
FIGS. 2 and 3 depict two sectional schematic views of two examples of connecting elements according to the invention.
Figure 3:
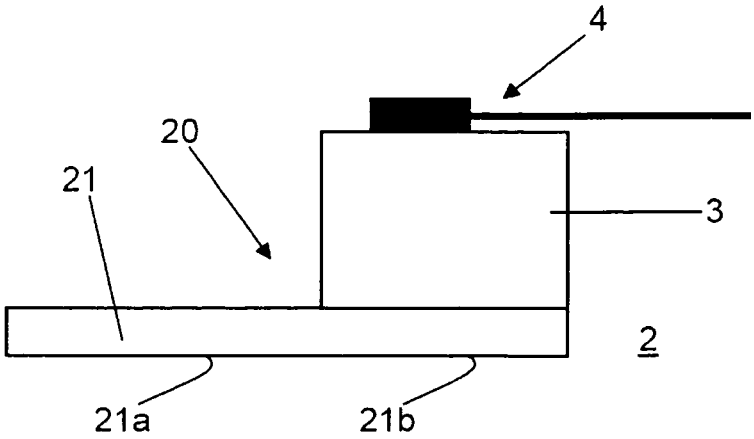

As is schematically depicted in FIGS. 2 and 3, the connecting element 2 according to the invention comprises an electrically conductive body 20 that includes an electrically conductive flexible foil 21 and an electrically conductive stiff section 22 or an electrically conductive stiff part 3, that is connected or is designed to be connected against the body 20, the section 22 or the part 3, that is connected with the foil 21.

The section 22 and the foil 21 constitute, in the exemplary embodiment of FIG. 2, a monoblock structure, with the section 22 thicker than the foil 21.

In the other example of FIG. 3, the part 3 is connected against the foil 21, for instance, by welding, crimping, soldering, riveting, clinching.

The foil 21 is designed to be connected with the component 11 of the window pane via an electrical connection surface 21*a*, whereas the section 22 or the part 3 is designed to be connected with an electrical supply conductor 4 in the direction of the outside of the window pane. This conductor 4 may be located outside the connecting element 2 and may be connected finally after the affixing of the connecting element on the window pane or is, preferably, part of the connecting element 2.

The connecting element 2 is designed to be affixed on the window pane, via an affixing surface 21*b* of the foil 21, which may or may not be separate from the electrical connection surface 21*a*.

The electrically conductive foil 21 is metallic. It has a thickness between 1 and 500 μm, in particular, between 1 and 200 μm and, preferably, between 1 and 100 μm. Its low thickness makes it possible for it to be flexible and, thus, if necessary, easy to fold in order to adapt the arrangement of the connecting element on the window pane. And, above all, it makes it possible that no strong stresses are transferred to the glass.

The foil 21 consists of one or a plurality of metal layers, for instance, a laminate composite with, for example, one or two layers of a silver alloy, in particular tin, and at least one intermediate layer of copper, a silver alloy layer, that is designed to be soldered onto the component 11.

The stiff section 22 or the stiff part 3 has a much greater thickness than the foil 21 in order to form an adequately stiff contact face for the conductor 4. The section 22 or the part 3 is preferably made of copper and has a thickness of 800 μm, for example.

FIG. 4 through 7 depict, by way of example, different variant embodiments of connecting elements.

FIGS. 4 and 5 depict bodies 20 of a connecting element with a flat parallelepiped shape, whereas that of FIG. 6 is disk-shaped. FIG. 7 shows the body 20 in the form of a parallelepiped-shaped envelope.

In FIGS. 5 and 7, it is seen that the conductor 4 is part of the connecting element 2, for example, this is a multifilament conductor 41 made of copper that is arranged inside a cylindrical or flat insulating sleeve 42, with the conductor having one end 43 that is welded onto the part 3 of the electrically conductive body 20, and an opposite free end 44, for example, of the plug-in type.

In FIG. 4, in contrast, the conductor 4 (not shown) is not part of the connecting element 2, for example, it is connected at a later time with a mechanical interface through mating of shapes.

In FIG. 6, the conductor 4 is also connected through part 3, being applied against it by pressure alone, with the end 45 of the conductor having the form of a spring leaf.

The section 22 or the stiff part 3 constitute [sic] the supply inlet of the connecting element 2, with the current coming from the conductor 4, whereas the foil constitutes the supply output of the connecting element, to ensure the power supply of the component 11 of the window pane.

The electrical connection between the connecting element 2 and the component 11 of the window pane is designed to be realized with a single contact between the foil 21 and the component 11 on an electrical connection surface 21*a* of the foil 21. This contact is obtained through soldering, welding, or even gluing using an electrically conductive adhesive of the connection surface 21*a*.

According to the invention, the connecting element 2 is designed to also be affixed mechanically on the window pane, even by means of the metal foil 21 on an affixing surface 21*b*, with the metallic foil itself constituting a substrate for the affixing.

Since the metallic foil 21 simultaneously ensures the electrical connection and the affixing of the connecting element and is connected with the section 22 or the part 3, it is important according to the invention that the stiff section 22 or the stiff part 3 not be in direct contact with the window pane through the single thickness of the foil 21. In fact, this characteristic prevents the heat stresses that have been generated in the stiff section 22 or the part 3 from being directly distributed in the window pane.

According to the invention, the connecting element includes intermediate means, in particular, shock-absorbing intermediate means that are arranged or are intended to be arranged against one of the surfaces of the foil 21, and facing this section 22 or this part 3.

Thus, the stiff section 22 or the part 3 is not designed to be in direct contact with the window pane via the thickness of the single metallic foil 21, which is designed to be affixed on the window pane.

The intermediate means are formed with a shock-absorbing material 5 or an air layer 6.

The thickness of the intermediate means is, in fact, between 1 and 2500 μm.

The shock-absorbing material 5 has, for example, the form of a polymer foam that is adhesive in order to be solidly connected with the metallic foil 21. It may also be a standard two-sided adhesive strip whose usual thickness is between 0.05 mm and 2.3 mm.

It is possible to distinguish different embodiment variants for the arrangement of the shock-absorbing material 5 or the air layer 6 depending on whether the electrical connection surface 21*a* of the affixing surface 21*b* is or is not separate.

The shock-absorbing material may be preferred when the body 20 has a flat parallelepiped shape (FIGS. 4 and 5). The material is arranged on the surface opposite the foil 21 and facing the part 3 on the affixing surface 21*b* of the foil 21, to, in turn, provide an affixing surface for the connecting element.

Figure 8:
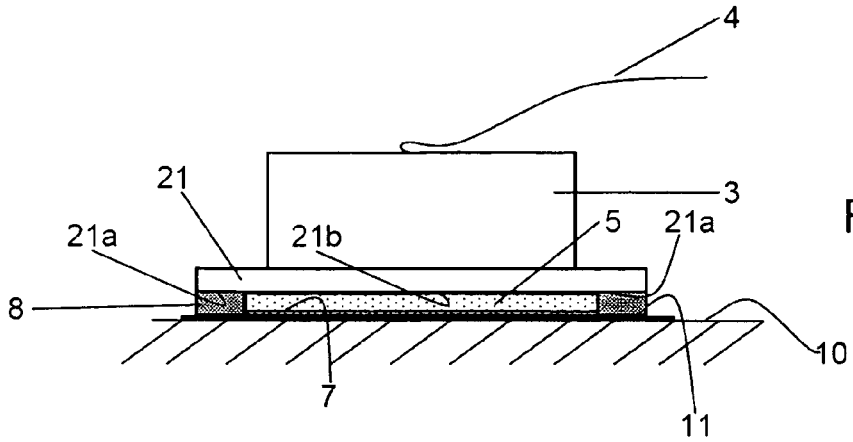
FIGS. 8 and 9 show sectional views of two variants of the connecting element according to FIG. 6.
Figure 9:
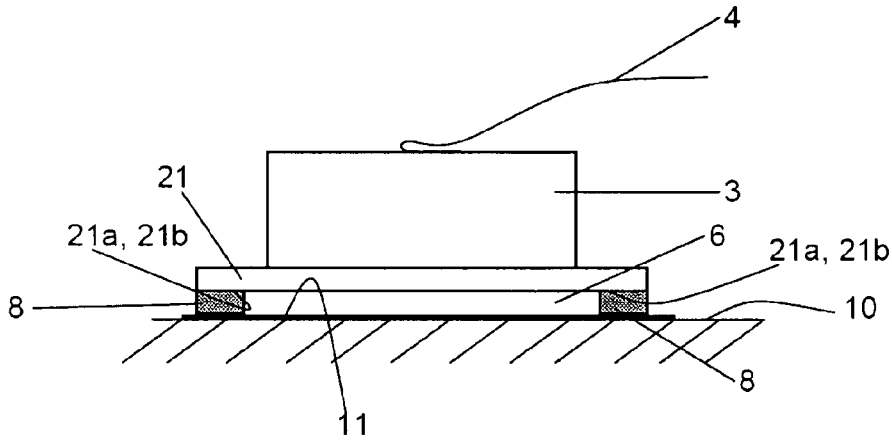

FIGS. 8 and 9 depict two variants of sectional views of FIG. 6. As shown in FIG. 8, it is possible to provide a shock-absorbing material 5 that is arranged on the surface opposite the foil 21 and facing the part 3 in the center of the circle that constitutes the affixing surface 21*b*, to, in turn, be affixed by connecting means 7 on the window pane. The surface 21*a* of the electrical connection is, for its part, arranged in a ring on the periphery of the circle in order to be connected with the component 11 of the window pane, for example, by means of a solder joint 8.

In FIG. 9 no shock-absorbing material is used, with an air layer 6 providing the non-contact of the part 3 with the window pane. The thickness of the solder joint 8 of the connection surface 21*a* against the component 11 of the window pane, with this surface provided as a ring on only the periphery of the circle and not facing the part 3 and forming the affixing surface 21*b*, suffices to provide the corresponding thickness of the air layer 6 between the foil 21 and the window pane facing the part 3.

As for FIG. 7, the body 20 consists of an envelope that provides in its interior an accommodation 23, with the connection surface 21*a* forming the affixing surface 21*b* that is designed to be welded or soldered against the component 11 of the window pane. The part 3 is in contact with the envelope 21; however, the part 3, and the accommodation 23, in which the shock-absorbing material 5 and part 3 is [sic] located, which is facing this shock-absorbing material, cannot be in contact with the window pane through the single thickness of the foil 21.

The material 5, which is preferably plastic-based, has the property of being heat resistant, because of its contact with the foil 21, which can be heated during the welding processes.

Figure 10:
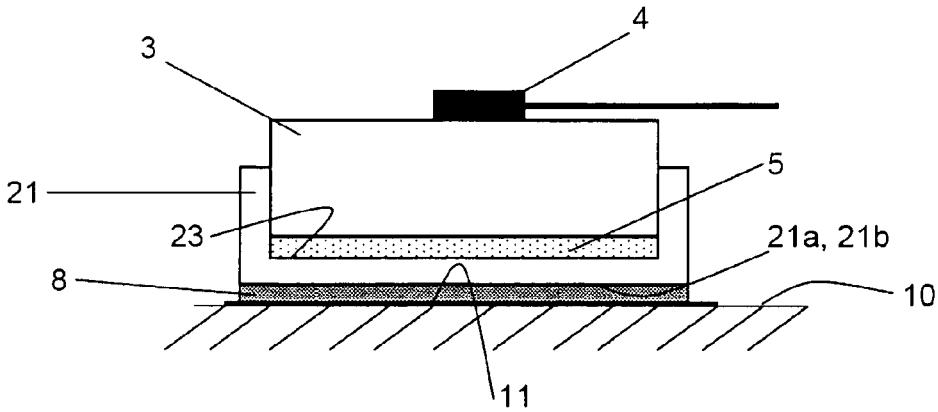
FIG. 10 shows a sectional view of a variant of the connecting element according to FIG. 7.

FIG. 10 depicts a variant embodiment in a sectional view of FIG. 7, with the envelope of the body 20 not completely closed along its longest dimension, but having, instead, a U shape. The shock-absorbing material 5 is arranged in the accommodation 23 formed by the bottom of the U, and the part 3 is placed directly above the material 5, with the electrical connection between the foil 21 and the part 3 occurring laterally by means of the sides of the U.

Figure 11:
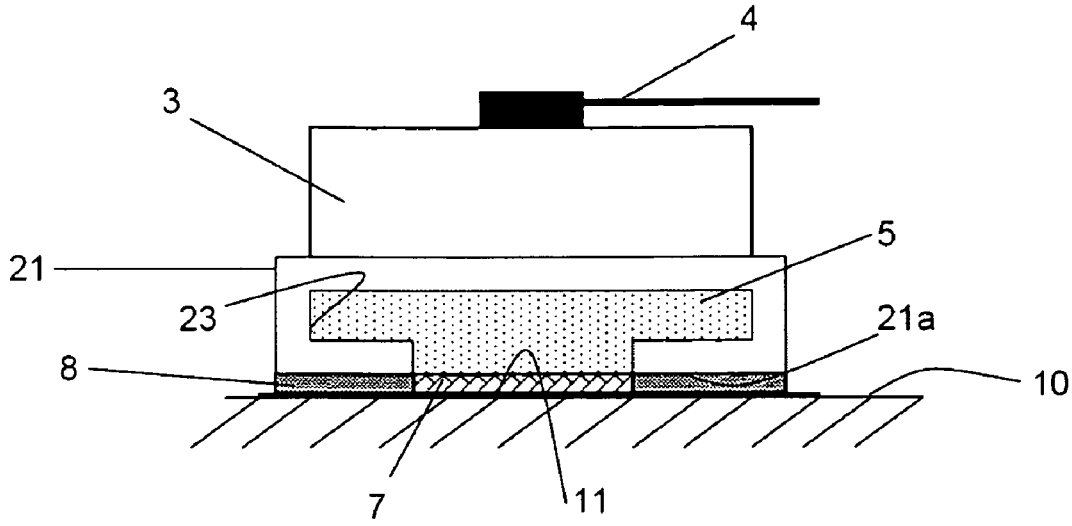
FIG. 11 through 14 depict sectional views of additional variants of the connecting element.
Figure 12:
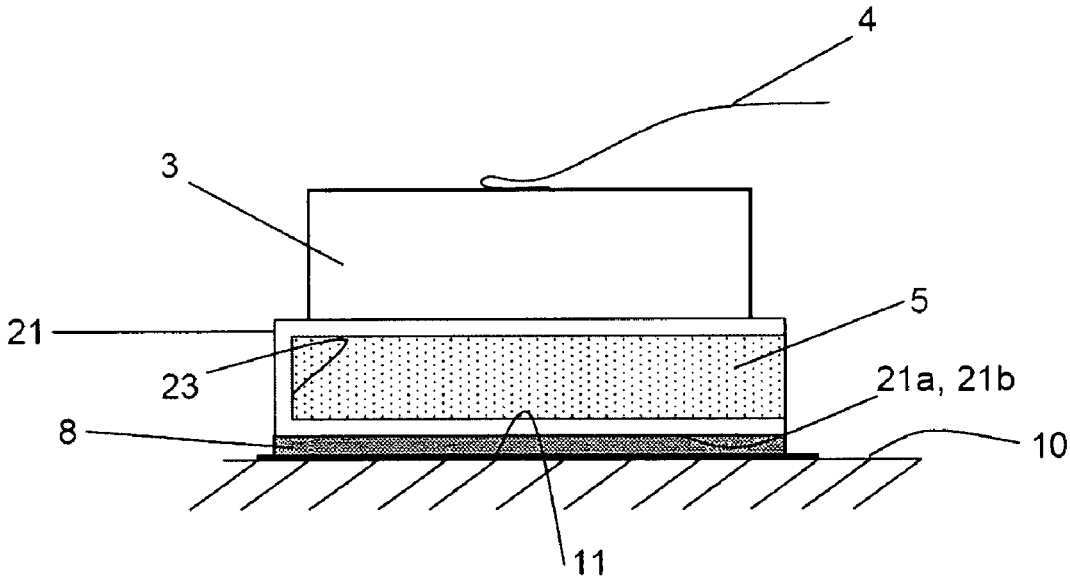

FIGS. 11 and 12 further show, in a sectional view, two additional variants of a connecting element whose film 21 has the shape of a half-closed envelope with the affixing of the element occurring via the shock-absorbing material 5 and connecting means 7 for FIG. 11, whereas, for FIG. 12, it is obtained via the direct solid connection of the film 21 with the solder joint 8.

When the affixing surface 21*b* forms the electrical connection surface 21*a*, the affixing of the connecting element is realized by welding, soldering, or gluing with an electrically conductive adhesive of the foil 21 against the component 11 of the window pane.

When the affixing surface 21*b* is separate from the electrical connection surface 21*a*, the affixing of the connecting element is realized by connecting means 7, which can be arranged on the shock-absorbing material 5 or can be formed by this shock-absorbing material, with the material connected against the affixing surface 21*b* of the foil 21 or the connecting means arranged directly on the affixing surface of the foil.

The connecting means may also be arranged on the glass film 10 of the window pane, with the connecting element thus connected against the connecting means.

The connecting means 7 may be an adhesive that is applied during the installation of the connecting element on the window pane.

The connecting means 7 may also be an integral part of the connecting element 2, such as, for instance, a two-sided adhesive strip, whose surface is solidly connected with the shock-absorbing material 5 and whose opposite surface, which is designed for affixing on the window pane, is provided with a protective coating, with it sufficing to remove it during installation of the connecting element on the window pane.

Simultaneously with the affixing of the connecting element via the shock-absorbing material 5, the connection surface 21*a* of the electrically conductive foil 21 is applied directly against the electrically conductive component 11 of the window pane to provide an electrical connection between the window pane and the connecting element. The single contact between the connection surface 21*a* and the component 11 is preferably reinforced by soldering, welding, or gluing using an electrically conductive adhesive.

It should be noted that for the purpose of further minimization of the propagation of stresses, the body 20, whose contact surface with the glass has a polygonal, roughly rectangular, shape can have no straight but round corners (FIG. 2).

Figure 13:
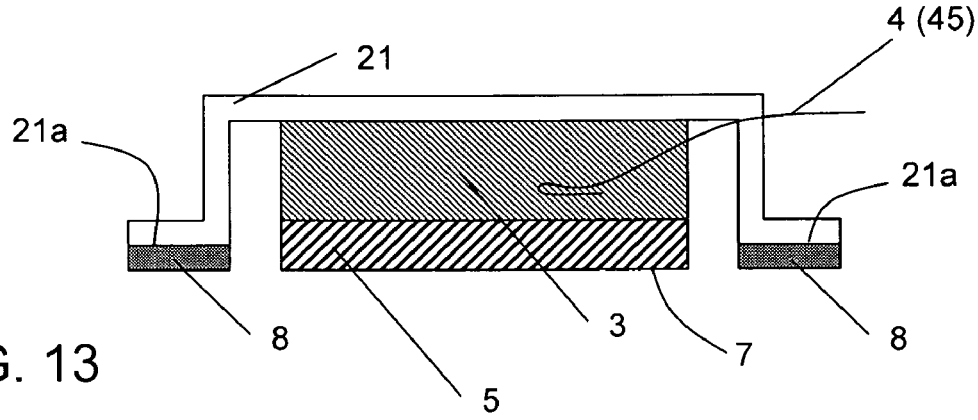
Figure 14:
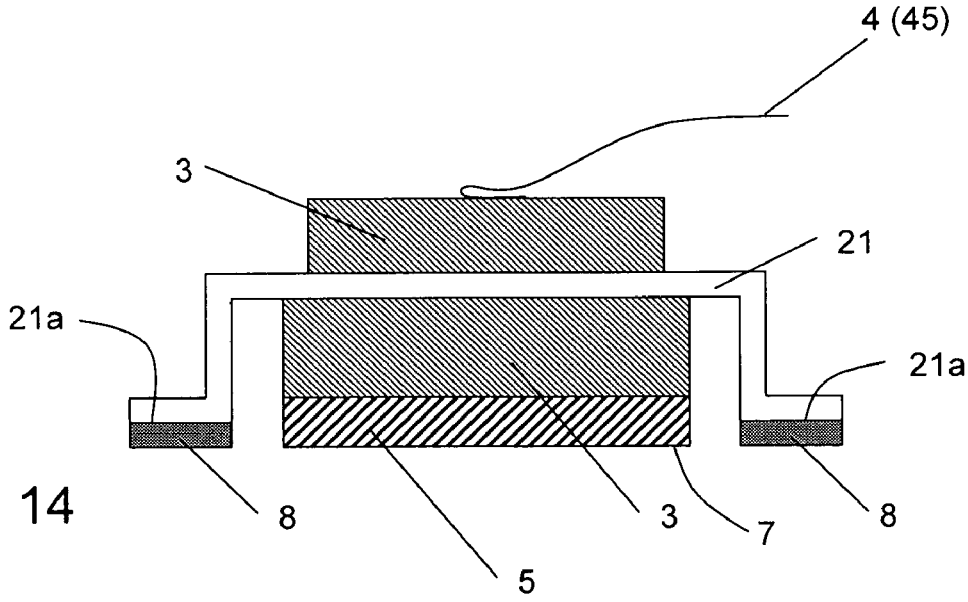

FIGS. 13 and 14 depict two variants of sectional views of the connecting element. As shown in FIG. 13, the stiff part 3 lies under the foil 21. As shown in FIG. 14, the foil 21 lies between the stiff parts 3.

The invention claimed is:

1. An electrical connecting element adapted to connect with at least one electrically conductive component of a window pane, the electrical connecting element comprising an electrically conductive body, the electrically conductive body comprising at least one electrically conductive foil that has a thickness between 1 and 500 μm, the electrically conducting foil comprising i) at least one electrical connection surface adapted to be in contact with the at least one electrically conductive component, and ii) at least one affixing surface separate from the electrical connection surface and adapted to fix the electrical connecting element on the window pane, the electrical conductive body further comprising an electrically conductive stiff section or an electrically conductive stiff part, that is adapted to be connected to the electrically conductive foil, and wherein the electrically conductive foil forms an envelope that comprises an internal accommodation to house intermediate means.

2. The electrical connecting element according to claim 1, wherein the electrically conductive foil has a thickness between 1 and 200 μm.

3. The electrical connecting element according to claim 1, wherein the intermediate means are adapted to be arranged on one of the surfaces of the electrically conductive foil, and the electrically conductive foil is located facing the electrically conductive stiff section or the electrically conductive stiff part.

4. The electrical connecting element according to claim 1, wherein the at least one affixing surface is formed by the at least one electrical connection surface.

5. The electrical connecting element according to claim 1, wherein the at least one affixing surface includes affixing means.

6. The electrical connecting element according to claim 1, wherein the at least one affixing surface comprises affixing means made of a two-sided adhesive strip optionally provided with a protective layer on the surface opposite that facing the affixing surface.

7. The electrical connecting element according to claim 1, wherein the affixing surface is configured to accommodate adhesive.

8. The electrical connecting element according to claim 1, wherein the intermediate means are adapted to be arranged facing the electrically conductive stiff section or the electrically conductive stiff part and on a the surface of the stiff section or stiff part opposite that of the electrically conductive foil, and wherein the intermediate means are adapted to be further connected with the affixing surface and configured to be affixed on the window pane.

9. The electrical connecting element of claim 1, wherein the intermediate means is a shock-absorbing material.

10. The electrical connecting element according to claim 9, wherein the shock-absorbing material also forms affixing means made of a two-sided adhesive.

11. The electrical connecting element according to claim 1, wherein the intermediate means are adapted to be arranged against the electrically conductive stiff section or the electrically conductive stiff part and on a surface of the electrically conductive stiff foil that supports the electrically conductive stiff section or the electrically conductive stiff part.

12. The electrical connecting element according to claim 1, wherein the electrically conductive stiff section or the electrically conductive stiff part are thicker than the electrically conductive foil and is adapted to be connected with an electrical conductor.

13. The electrical connecting element according to claim 1, wherein the electrically conductive stiff section or the electrically conductive stiff part are made of copper.

14. The electrical connecting element according to claim 1, wherein the electrical connection surface is adapted to accommodate electrically conductive adhesive or is adapted to be soldered or welded.

15. The electrical connecting element according to claim 1, wherein the intermediate means are not made of pure metal.

16. The electrical connecting element according to claim 9, wherein the shock-absorbing material is plastic-based, and contains metal particles.

17. The electrical connecting element according to claim 1, wherein the intermediate means has a thickness between 1 and 2500 μm.

18. The electrical connecting element according to claim 1, wherein the electrically conductive foil is a flexible metal foil.

19. The electrical connecting element according to claim 1, wherein the electrically conductive foil comprises two or more metal layers inclusive of at least one layer made of copper and at least one layer that contains silver, tin, and/or copper, said two or more metal layers adapted to be in contact with the at least one electrically conductive component of the window pane.

20. The electrical connecting element according to claim 1, wherein at least one of the surfaces of the foil that is adapted to be in contact with the at least one electrically conducting component of the window pane has a polygonal shape with rounded corners.

21. A window pane, comprising at least one electrical connecting element according to claim 1.

22. The window pane according to claim 21, said window pane being a heated window pane and/or a window pane with an antenna.

23. A method for assembling the electrical connecting element of claim 1, comprising:

connecting the intermediate means made of a shock-absorbing material with the affixing surface of the electrically conductive foil of the body of the connecting element, affixing the shock absorbing material on the window pane, Soldering, welding or gluing the previously connected electrically conductive foil onto the electrically conductive component of the window pane, and welding the electrically conductive stiff part, onto the electrically conductive foil opposite the shock-absorbing material.

24. The electrical connecting element of claim 1, wherein the intermediate means is located between the electrically conducting foil and the at least one electrically conductive component of the window pane, and wherein electrical connection between the electrically conducting foil and the stiff section or stiff part occurs along the entirety of a bottom surface of the stiff section or stiff part.

25. The electrical connecting element of claim 1, wherein the intermediate means is located between the stiff section or stiff part and the electrically conducting foil, and wherein connection between the stiff section or stiff part and the intermediate means occurs along the entirety of the bottom surface of the stiff section or stiff part.

26. The electrical connecting element of claim 1, wherein the stiff section or stiff part is located between the electrically conductive foil and the intermediate means, and wherein electrical connection between the electrically conducting foil and the stiff section or stiff part occurs along the entirety of a top surface of the stiff section or stiff part.

27. The electrical connecting element of claim 1, wherein the electrically conductive foil is located between a first portion of the stiff section or stiff part and a second portion of the stiff section or stiff part, the intermediate means being located under the second portion of the stiff section or stiff part, wherein electrical connection between the electrically conducting foil and the stiff section or stiff part occurs along the entirety of a bottom surface of the first portion of the stiff section or stiff part and along the entirety of a top surface of the second portion of the stiff section or stiff part.

28. The electrical connecting element of claim 1, wherein the electrical conductive body further comprises the intermediate means made of a shock-absorbing material or an air layer, wherein the stiff section or stiff part comprises a planar surface contacting the electrically conductive foil along an entire extension of said planar surface or contacting the intermediate means along an entire extension of said planar surface.

* * * * *

UNITED STATES PATENT AND TRADEMARK OFFICE

CERTIFICATE OF CORRECTION

PATENT NO. : 8,109,782 B2
APPLICATION NO. : 12/678284
DATED : February 7, 2012
INVENTOR(S) : Ziegler et al.

It is certified that error appears in the above-identified patent and that said Letters Patent is hereby corrected as shown below:

Column 3, line 56, the word "[sic]" should be removed.

Column 6, line 11, the word "[sic]" should be removed.

Column 7, line 23, the word "[sic]" should be removed.

Column 8, line 65, the word "a" should be removed.

Signed and Sealed this
Third Day of April, 2012

David J. Kappos
*Director of the United States Patent and Trademark Office*